United States Patent [19]

Bar-on et al.

[11] 4,081,213

[45] Mar. 28, 1978

[54] FUSER DRIVE SYSTEM

[75] Inventors: Ari Bar-on, Rochester; Louis R. Hattler, Marion, both of N.Y.

[73] Assignee: Xerox Corporation, Stamford, Conn.

[21] Appl. No.: 681,361

[22] Filed: Apr. 29, 1976

[51] Int. Cl.[2] ..... G03G 15/00

[52] U.S. Cl. ..... 355/3 FU; 219/216; 432/60; 432/228

[58] Field of Search ..... 355/3 R, 3 FU, 14; 219/216; 432/60, 228

[56] References Cited

U.S. PATENT DOCUMENTS

| | | | |
|---|---|---|---|
| 3,268,351 | 8/1966 | Van Dorn | 355/3 X |
| 3,291,466 | 12/1966 | Aser et al. | 355/3 X |
| 3,998,584 | 12/1976 | Wada et al. | 432/60 |
| 4,000,943 | 1/1977 | Bar-on | 355/14 X |

*Primary Examiner*—Fred L. Braun
*Attorney, Agent, or Firm*—J. J. Ralabate; C. A. Green; H. Fleischer

[57] ABSTRACT

A fusing apparatus in which particles are substantially permanently affixed to a sheet. The fusing apparatus includes a fusing member operatively associated with a back-up member to define a nip through which a sheet passes. In the operating mode, the fuser member is heated to the operating temperature with liquid release material being applied thereto. The fuser member is heated to a temperature lower than the operating temperature in the standby mode. To prevent the formation of a bead release material on the fuser member in the standby mode of operation, relative movement is generated between the fuser member and backup member.

6 Claims, 3 Drawing Figures

FUSER DRIVE SYSTEM

BACKGROUND OF THE INVENTION

This invention relates generally to an electrostatographic printing machine, and more particularly concerns a fusing apparatus employed therein.

In the process of electrostatographic printing, a latent image is recorded on a surface and rendered visible with particles. These particles are transferred to a sheet of support material in image configuration. Thereafter, the particles are permanently affixed to the sheet of support material forming thereon a copy of the original document. Electrostatographic printing includes both electrophotographic printing and electrographic printing. Generally, electrophotographic printing employs a photoconductive member which is charged to a substantially uniform level. A light image of an original document is projected onto the charged photoconductive member selectively dissipating the charge thereon. This records a latent image of the original document on the photoconductive member. Electrographic printing is distinguishable from electrophotographic printing in that it does not use a photoconductive member or a light image to create the latent image of the original document. However, in both of the foregoing processes, heat settable particles are generally employed to develop the latent image. After the particles are transferred to the sheet of support material, heat is applied thereto so as to permanently affix them to the sheet of support material.

Numerous techniques have been developed for applying heat to the particles transferred to the sheet of support material. One approach passes the sheet of support material, with the particles thereon, between a pair of opposed rollers. The outer surface of the heated fuser roll may be covered with polytetrafluoroethylene, commonly known as Teflon, to which a release agent such as a silicon is applied. This Teflon layer has a thickness of about several mils. The layer of oil applied thereto has a thickness of less than one micron. Silicon based oil possess a relatively low surface energy and is particularly advantageous for use with Teflon. A thin layer of this oil is applied to the surface of the heated roll and forms an interface between the roll surface and powder image on the sheet of support material. The low surface energy of this layer prevents the particles from transferring to the roll. Thus, the particles remain adhering to the sheet of support material. In this way, the particles are permanently affixed to the sheet of support material and do not smear or transfer to the fuser roll.

An alternative technique, employs a bare, heated metal roller. A low molecular weight polyethylene is applied, as a release agent, to this type of roller. The release agent is a liquid at the fuser roll operating temperature. In operation, a portion of the fuser roll continuously rotates through a sump containing the release material. In this manner, the release material is deposited on the surface of the fuser roll and a doctor blade, in contact therewith, regulates the thickness of the layer coated thereon. However, it has been found that during the standby mode, i.e., when the fuser roll is stationary, a thin layer of release material, which because of the wetting action, climbs the roller surface. At this point, because of oxidation and temperature, the polyethylene cross links and forms a bead (similar to a weld bead) of a brown substance on the heated bare metal surface.

These beads will mar the copies being reproduced by the electrophotographic printing machine.

Accordingly, it is a primary object of the present invention to improve the fusing apparatus employed in an electrophotographic printing machine to prevent the formation of beads on the fuser roll employed therein.

SUMMARY OF THE INVENTION

Briefly stated, and in accordance with the present invention, there is provided a fusing apparatus for substantially permanently affixing particles to a sheet.

Pursuant to the features of the present invention, the fusing apparatus is heated to a first temperature in the operating mode and a second temperature, less than the first mode temperature, in the standby mode. A backup member is operatively associated with the fuser member to define a nip through which the sheet having the particles thereon passes. Means are provided for applying release material to the fuser member. During the standby mode, means generate relative movement between the fuser member and the backup member to prevent the formation of beads on the fuser member.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
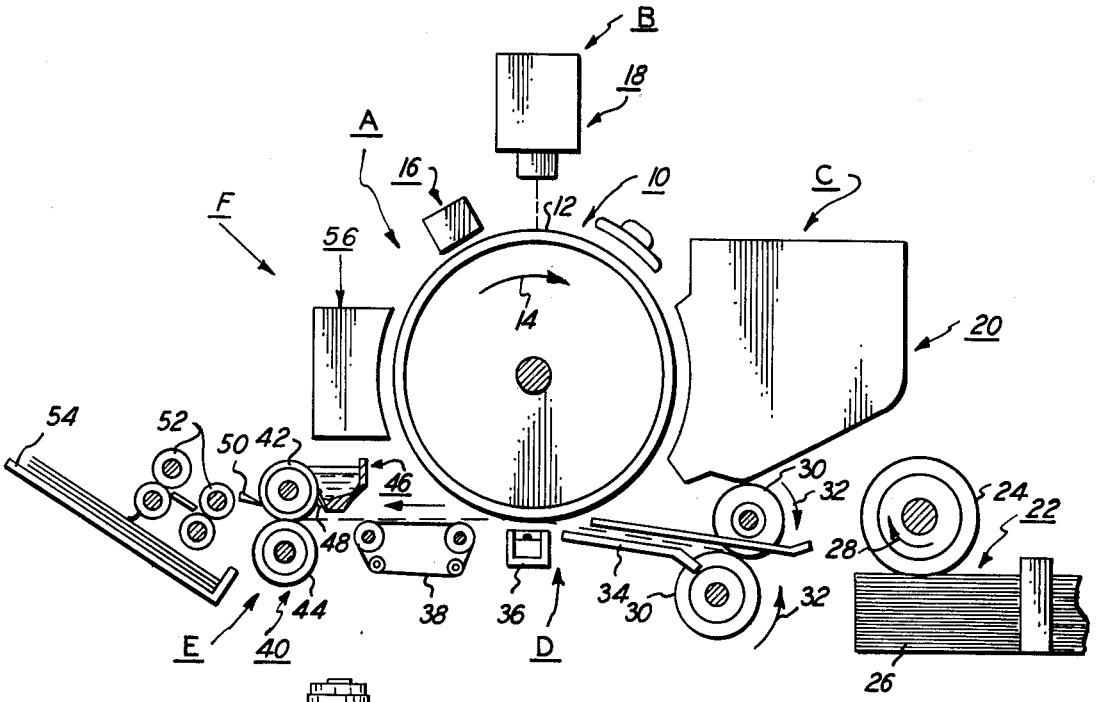
FIG. 1 is a schematic elevational view illustrating an electrophotographic printing machine having a fusing apparatus incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the apparatus of the present invention is particularly well adapted for use in a fusing apparatus, it should become evident from the following discussion that it is equally well suited for application in a wide variety of devices and is not necessarily limited to the particular embodiment shown herein.

Inasmuch as the art of electrophotographic printing is well known, the various processing stations for producing a copy of an original document will be represented in FIG. 1 as blocks. Each of these blocks will be described briefly hereinafter.

Referring now to FIG. 1, the electrophotographic printing machine employs a drum 10 having photoconductive surface 12 entrained about and secured to the exterior circumferential surface thereof. As drum 10 rotates in the direction of arrow 14, it passes through the various processing stations disposed about the periphery thereof. A suitable photoconductive material may be the type of selenium alloy described in U.S. Pat. No. 2,970,906 issued to Bixby in 1961.

Initially, drum 10 rotates a portion of photoconductive surface 12 through charging station A. Charging station A includes a corona generating device, indicated generally by the reference numeral 16, positioned closely adjacent to photoconductive surface 12. Corona generating device 16 charges photoconductive surface 12 to a relatively high substantially uniform potential. A suitable corona generating device is described in U.S. Pat. No. 2,836,725 issued to Vyverberg in 1958.

Exposure station B includes an exposure mechanism, indicated generally by the reference numeral 18, having a stationary housing for supporting original document thereon. The housing comprises a transparent platen upon which the original document is positioned. Lamps illuminate the original document. Scanning of the original document is achieved by oscillating a mirror in a timed relationship with the movement of drum 10, or, in lieu thereof, by moving the lamp and lens system to form a flowing light image thereof. The light image of the original document is projected onto the charged portion of photoconductive surface 12. In this manner, photoconductive surface 12 is selectively irradiated to dissipate the charge thereon and record an electrostatic latent image corresponding to the informational areas contained within the original document.

Next, the electrostatic latent image recorded on photoconductive surface 12 is rotated to development station C. At development station C, a developer unit 20 having a housing with a supply of developer mix contained therein renders the electrostatic latent image visible. The developer mix comprises carrying granules having toner particles adhering thereto. These carrier granules are formed from a magnetic material while the toner particles are usually a heat settable plastic. Preferably, developer unit 20 is a magnetic brush development system. In such a system, the developer mix is brought through a directional flux field forming a brush thereof. The brush of developer mix contacts the electrostatic latent image recorded on photoconductive surface 12. The latent image attracts electrostatically the toner particles from the carrier granules to form a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost surface of the stack of sheets of support material 26. Feed roll 24 rotates in the direction of arrow 28 to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D. Transfer station D includes a corona generating device 36. Corona generating device 36 sprays ions onto the side of the sheet of support material opposed from photoconductive surface 12. The toner powder image adhering to photoconductive surface 12 is then attracted therefrom to the surface of the sheet of support material in contact therewith. After transferring the toner powder image to the sheet of support material, endless belt conveyor 38 advances the sheet of support material to fixing station E.

Fixing station E includes a fuser assembly, indicated generally by the reference numeral 40. Fuser assembly 40 heats the transferred powder image to permanently affix to toner particles to the sheet of support material. Preferably, fuser assembly 40 includes a heated fuser member or roll, shown generally at 42, and a backup member or roll, indicated generally by the reference numeral 44. The sheet of support material, with the toner powder image thereon, is interposed between fuser roll 42 and backup roll 44. The toner powder image contacts fuser roll 42. Release material applicator 46 supplies release material to fuser roll 42. Release material applicator 46 includes a sump housing a supply of polyethylene. When fuser roll 42 is heated, the polyethylene contained within the sump of release material applicator 46 liquifies. As fuser roll 42 rotates a portion thereof passes through the sump containing the release material. In this manner, the release material is applied to the surface of fuser roll 42. Blade 48, closely adjacent to fuser roll 42, regulates the thickness of the layer of release material coating fuser roll 42. The detailed operation of the fuser drive assembly will be described hereinafter in greater detail with reference to FIGS. 2 and 3. After the toner powder image is permanently affixed to the sheet of support material, stripper blade 50 separates the sheet from fuser roll 42. Thereafter, the sheet of support material is advanced by a series of rollers 52 to catch tray 54 for subsequent removal from the printing machine by the operator.

Invariably, residual toner particles remain adhering to photoconductive surface 12 after the transfer of the powder image to the sheet of support material. These residual toner particles are removed from photoconductive surface 12 at cleaning station F. Cleaning station F includes a cleaning mechanism, generally designated by the reference numeral 56, having a corona generating device and brush contacting photoconductive surface 12. Initially, the toner particles are brought under the influence of the corona generating device to neutralize the electrostatic charge remaining on photoconductive surface 12 and that of the residual toner particles. Thereafter, the neutralized toner particles are removed from photoconductive surface 12 by the rotatably mounted fibrous brush in contact therewith. After cleaning, a discharge lamp floods photoconductive surface 12 to return it to the initial level prior to the recharging thereof at station A for the next successive imaging cycle.

It is believed that the foregoing description is sufficient for purposes of the present application to illustrate the general operation of an electrophotographic printing machine which exemplifies one type of electrostatographic printing machine employing the present invention.

Figure 3:
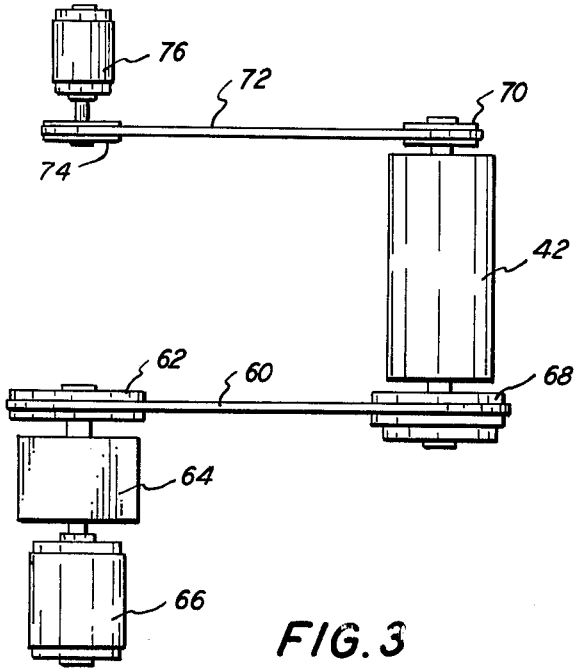
FIG. 3 is a schematic plan view depicting the FIG. 2 drive mechanism.
Figure 2:
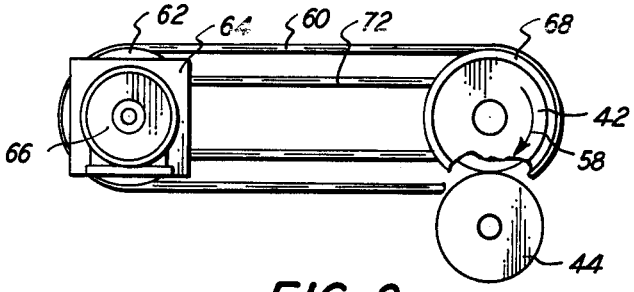
FIG. 2 is a schematic elevational view showing the drive mechanism for the fusing apparatus of the FIG. 1 printing machine.

Referring now to the specific subject matter of the present invention, FIGS. 2 and 3 depict, partially, the fusing apparatus employed in the FIG. 1 printing machine. Fuser assembly 40 includes a heated fuser roll, indicated generally by the reference numeral 42, and a backup roll, indicated generally by the reference numeral 44. Fuser roll 42 cooperates with backup roller 44 to define the nip through which the sheet of support material having the toner powder image thereon passes. The sheet of support material is oriented so that the toner powder image thereon contacts fuser roll 42. A channel shaped base (not shown) is provided for supporting fuser assembly 40 in the electrophotographic printing machine shown in FIG. 1. Backup roll 44 is mounted rotatably on a pair of brackets secured to the channel shaped base by means of a right angle bracket. Preferably, backup roll 44 includes a rigid steel core or shaft having a Viton elastomeric surface or layer disposed thereover and affixed thereto. The shaft is secured rotatably on brackets by a pair of bearings thereto by retaining rings.

A pair of brackets (not shown) having a generally E-shaped configuration are provided for mounting fuser roll 42 rotatably in fuser assembly 40. To this end, a pair of ball bearings, one mounted in each of the support brackets provides a rotatable support. The bearings are retained in the brackets by means of retaining rings. A pair of end caps are secured to a hollow cylinder or core forming fuser roll 42. The end caps have reduced portions so as to be mounted in the bearings permitting fuser roll 42 to rotate in the direction of arrow 58. A heating element is supported internally of fuser roll 42 providing thermal energy to the outer surface thereof and heating it to the operating temperature. The heating element develops sufficient energy to elevate the surface temperature of fuser roll 42 to the operational temperature thereof, i.e., about 285° to about 295° F. By way of example, the heating element may include a quartz envelope having a tungsten resistant heating element disposed therein. Preferably, fuser roll 42 is fabricated from any suitable material capable of effficiently conducting heat to the external surface thereof. For example, suitable materials are aluminum and alloys thereof, steel, stainless steel, nickel and nickel alloys thereof, nickel plated copper, chromium plated copper, and alloys thereof. Fuser roll 42 requires about 420 watts peak power with the average being about 320 watts, and about 100 watts being required for standby operation. The heating element is supported internally of fuser roll 42 and electrically connected to a power supply mounted externally thereof. In the standby mode, the temperature of fuser roll 42 is about 125° F. The material from which the outer surface of fuser roll 42 is fabricated has a relatively high surface energy. Thus, toner material in contact therewith readily wets the surface thereof. The toner wetting the surface of fuser roll 42 is difficult to remove. Accordingly, release material applicator 46 applies a low molecular weight substance which is a liquid with a relatively low viscosity at the operating temperature. An example of such a material is polyethylene manufactured by Allied Chemical Company and having a designation AC-8 homopolymer.

In the standby mode, if fuser roll 42 is stationary, the polyethylene cross links and forms a bead of brown substance on the surface of fuser roll 42. This bead mars the copies being reproduced by the printing machine. In order to prevent the formation of this bead, fuser roll 42 is rotated continuously. Thus, in the operating mode, fuser roll 42 rotates at a substantially higher angular velocity than in the standby mode. For example, fuser roll 42 may operate at from about 3 to 5 revolutions per minute in the operating mode while in the standby mode, it rotates at about 1 revolution per minute. The drive mechanism for rotating fuser roll 42 includes an endless belt 60 entrained about pulley 62 (FIG. 3). Pulley 62 is coupled to a reduction gear box 64 which, in turn, is coupled to motor 66. The combination of motor 66 and gear box 64 produces a torque of about 1,200 oz.-in. Motor 66 operates at 50 or 60 hertz. Belt 60 is entrained about clutch 68 (FIG. 3). Clutch 68 is mounted in the region of one end portion of fuser roll 42. In the standby mode, clutch 68 is in engagement and belt 60 drives fuser roll 42 at about 1 revolution per minute. Contrawise, in the operating mode, clutch 68 is disengaged and belt 60 no longer drives fuser roll 42. The angular rotation of fuser roll 42, in the standby mode, prevents the formation of the bead on the surface thereof.

With continued reference to FIGS. 2 and 3, the drive system for the standby mode of operation includes endless belt 60 entrained about clutch 68 and pulley 62. Pulley 62 is coupled to reduction gear box 64 which, in turn, is coupled to motor 66. The diameter of pulley 62 is substantially the same as that of clutch 68. In this mode of operation, clutch 68 is in engagement and fuser roll 42 is driven thereby. Thus, motor 66 rotates the gears in reduction gear box 64 which, in turn, drive pulley 62. Rotation of pulley 62 advances belt 60 which, in turn, rotates clutch 68. Rotation of clutch 68, rotates fuser roll 42 at the standby speed, i.e., at about 1 revolution per minute. Clutch 68 may be a positive clutch which is designed to transmit torque without slip. However, in lieu thereof, a suitable friction clutch may also be employed. For purposes of explanation, it will be assumed that a positive clutch is employed. A solenoid (not shown) moves the inner portion of the clutch into engagement with the outer portion. Belt 60 is entrained about the outer portion of clutch 68. Thus, only when the inner portion is in engagement therewith, will fuser roll 42 be driven by clutch 68.

In the operating mode, clutch 70 drives fuser roll 42 at a suitable speed, i.e., at about 3 to 5 revolutions per minute, with clutch 68 being disengaged. Clutch 70 is of the same type as clutch 68. However, it is only engaged in the operating mode and remains disengaged in the standby mode. Thus, when clutch 68 is disengaged, clutch 70 is engaged. Belt 72 entrained about clutch 70 and pulley 74 drives clutch 70. Pulley 74 is coupled to motor 76. Motor 76 rotates at the desired angular velocity. In this manner, fuser roll 42 rotates at a first speed in the standby mode which is substantially less than the second speed in the operating mode. For example, when clutch 68 is engaged and clutch 70 is disengaged, fuser roll 42 rotates at one revolution per minute. However, when clutch 68 is disengaged and clutch 70 is engaged, fuser roll 42 rotates at about three to five revolutions per minute.

In the standby mode of operation, the machine ON button is activated. Depressing the ON button energizes the solenoid to engage clutch 68 and disengage clutch 70. The printing machine is shifted from the standby mode to the operating mode by pressing the PRINT button. Activation of the PRINT button energizes the solenoid to disengage clutch 68 and engage clutch 70.

In recapitulation, it is evident that the drive mechanism rotates the fuser roll of a fusing apparatus in both the standby and operating mode of operation. In the standby mode of operation, the fuser roll rotates at a speed sufficient to prevent the formation of beads on the surface thereof. In the operating mode, the fuser roll rotates at an optimum speed to permanently affix toner particles to the sheet of support material passing therethrough.

It is, therefore, evident that there has been provided, in accordance with the present invention, an apparatus for preventing the formation of beads on the surface of a fuser roll employed in a fusing apparatus of an electrophotographic printing machine. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A fusing apparatus for substantially permanently affixing particles to a sheet, including:

a fuser roll heated to a first temperature in the operating mode and a second temperature, less than the first temperature, in the standby mode;

a backup roll, operatively associated with said fuser roll, to define a nip through which the sheet having the particles thereon passes;

means for applying release material to said fuser roll;

first drive means coupled to said fuser roll to rotate said fuser roll relative to said backup roll in the standby mode, said first drive means being de-coupled from said fuser roll in the operating mode; and second drive means coupled to said fuser roll in the operating mode to rotate said fuser roll at a greater angular velocity than said first drive means rotates said fuser roll in the standby mode.

2. An apparatus as recited in claim 1, wherein said first drive means includes:

a motor;

a clutch mounted in the region of one end portion of said fuser roll; and an endless belt coupling said clutch to said motor, said clutch disengaging said belt from said fuser roll in the operating mode and engaging said belt with said fuser roll in the standby mode.

3. An apparatus as recited in claim 1, wherein said first drive means rotates said fuser roll at about one revolution per minute in the standby mode.

4. An electrostatographic printing machine, including:

an image receiving member;

means for recording the latent image on said image receiving member;

means for developing the latent image recorded on said image receiving member with particles;

means for transferring the particles to a sheet in image configuration; and means for substantially permanently fusing the particles to the sheet, said fusing means comprising a fuser roll heated to a first temperature in the operating mode and a second temperature, less than the first temperature, in the standby mode, a backup roll, operatively associated with said fuser roll, to define a nip through which the sheet having the particles thereon passes, means for applying release material to said fuser roll, first drive means coupled to said fuser roll to rotate said fuser roll relative to said backup roll in the standby mode, said first drive means being de-coupled from said fuser roll in the operating mode, and second drive means coupled to said fuser roll in the operating mode to rotate said fuser roll at a greater angular velocity than said first drive means rotates said fuser roll in the standby mode.

5. A printing machine as recited in claim 4, wherein said first drive means of said fusing means includes:

a motor;

a clutch mounted in the region of one end portion of said fuser roll; and an endless belt coupling said clutch to said motor, said clutch disengaging said belt from said fuser roll in the operating mode and engaging said belt with said fuser roll in the standby mode.

6. A printing machine as recited in claim 4, wherein said first drive means of said fusing means rotates said fuser roll at about one revolution per minute in the standby mode.

* * * * *